United States Patent [19]

Lin

[11] 4,155,553

[45] May 22, 1979

[54] BALL STORING TARGET AND PROJECTOR

[76] Inventor: Shi-Tron Lin, 1201 W. 30th St., Los Angeles, Calif. 90007

[21] Appl. No.: 710,919

[22] Filed: Aug. 2, 1976

[51] Int. Cl.[2] ..... A63B 63/04; A63B 65/12

[52] U.S. Cl. ..... 273/102.1 G; 273/101; 273/96 R; 273/103

[58] Field of Search ..... 124/1, 36, 56, 79, 50, 124/41 R, 49, 4, 6; 273/96 R, 26 R, 26 A, 101, 29 A, 102 R, 102 AP, 102 S, 102.4, 103, 122 R, 125 R, 127 R, 127 C, 127 D, 179 R, 179 B, 179 E, 95 G, 102.1

[56] References Cited

U.S. PATENT DOCUMENTS

| | | | |
|---|---|---|---|
| Re. 18,163 | 8/1931 | Garver | 273/95 G |
| 1,242,942 | 10/1917 | Hunsberger | 273/102.1 G X |
| 1,506,171 | 8/1924 | Filberg | 124/4 |
| 1,886,479 | 11/1932 | Greenan | 273/95 G |
| 2,426,551 | 8/1947 | Frisch | 273/95 R |
| 2,991,083 | 7/1961 | Hartung | 273/127 C X |
| 3,172,665 | 3/1965 | Glass et al. | 273/127 R X |
| 3,365,199 | 1/1968 | Scholin et al. | 273/127 R X |
| 3,561,761 | 2/1971 | Klemma | 273/103 X |
| 3,647,213 | 3/1972 | Baker | 124/4 X |
| 3,788,643 | 1/1974 | Morrison et al. | 273/102.1 G |
| 3,844,559 | 10/1974 | Davidson et al. | 273/102 AP X |
| 3,854,728 | 12/1974 | Brandell | 273/127 D X |
| 3,915,454 | 10/1975 | Saunders et al. | 273/127 R |
| 3,920,245 | 11/1975 | Gothreaux et al. | 273/127 C X |

FOREIGN PATENT DOCUMENTS

| | | | |
|---|---|---|---|
| 635274 | 11/1963 | Belgium | 273/95 G |

*Primary Examiner*—Vance Y. Hum

*Attorney, Agent, or Firm*—Fulwider, Patton

[57] ABSTRACT

A ball game machine, which after being hit by an incoming ball, will return another ball with a minimum loss of energy. The incoming ball stops at the ball receiver and transmits almost all of its kinetic energy to the machine through proper inertia design. Instantaneously, the recoiling ball receiver mechanically causes a bat to strike a second ball which has been stored in a collector. The incoming ball then drops into the collector and becomes a stored ball so that the operation can be repeated.

11 Claims, 4 Drawing Figures

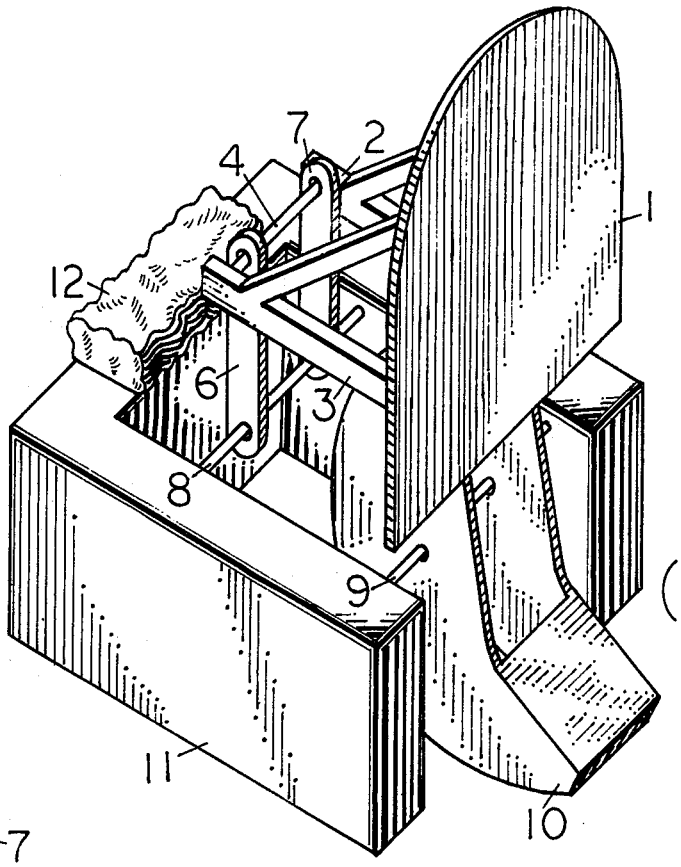
(FIG. 1)
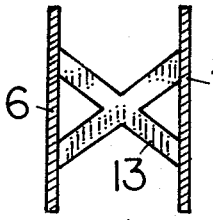
(FIG. 2)
(FIG. 3)
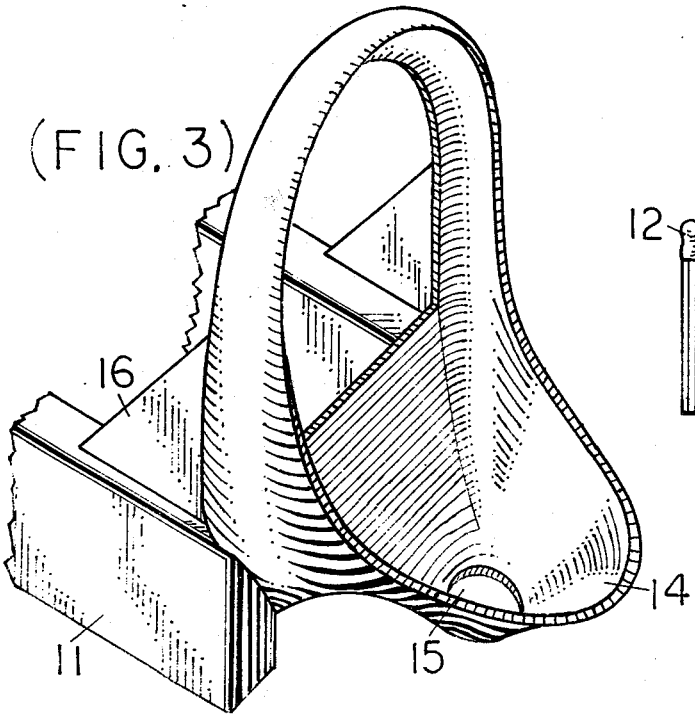
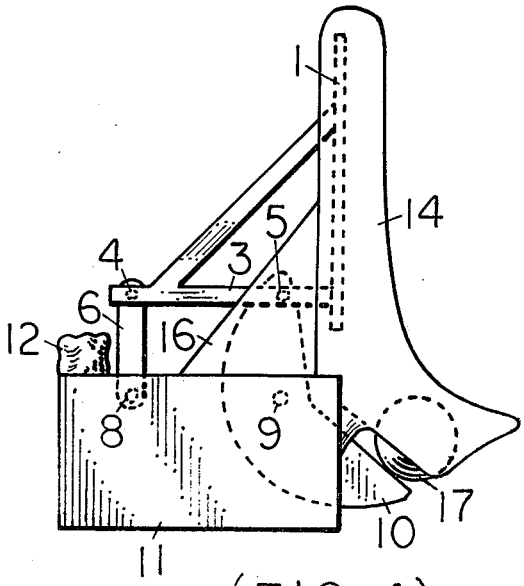
(FIG. 4)

BALL STORING TARGET AND PROJECTOR

BACKGROUND OF THE INVENTION

The laws of conservation of kinetic energy and momentum explain why a hard bouncing ball hitting a line of similar balls stops completely along with the other balls except the one at the far end, which moves away after the collision with substantially all the kinetic energy.

Similarly, the laws of conservation of kinetic energy and angular momentum explain the following: Suppose there is a bar of length 2R, with its center rotatably secured to a shaft of fixed position. Immediately in front of one end of the bar lies a ball of mass M. Now someone throws another ball of the same kind at the other end of the bar. If at the instant of collision, the inertia of the bar and each ball are the same relative to the shaft, i.e., if $MR^2$ equals the inertia of the bar, then the incoming ball stops completely with the bar, and only the other ball is returned. If the bar is of a certain shape so that the other ball bounces back at a 45° C. elevation, then it can travel high and far despite energy losses during the collision.

SUMMARY OF THE INVENTION

Following the theory explained above, the ball exchanger of the present invention comprises a ball receiver connected to a bat, which is pivotably secured to a shaft. The ball receiver has to be large; otherwise one may miss it every time. The apparent inertia of the ball relative to the receiver tends to vary over a large range depending upon the precise point of impact of the ball. Therefore, the inertia of the ball and receiver cannot be properly matched. The incoming ball might bounce back or move forward with the receiver, either movement resulting in wasted energy. This problem is solved, however, by supporting the receiver in such a way that it maintains a predetermined position with respect to the ball. In one form of the invention, there is accomplished by an arrangement of parallel bars and parallel shafts connected so as to transfer the energy in substantially the same manner regardless of the point of impact on the receiver.

Other features and advantages of the present invention will become apparent from the following detailed description of a preferred embodiment thereof and the attached drawings which illustrates, by way of example, the principles of the invention.

BRIEF DESCRIPTION OF THE DRAWINGS

FIG. 1 is a perspective view of the ball exchanger with the collector removed;

FIG. 2 is a plane view of the bars of the ball exchanger reinforced by a cross frame;

FIG. 3 is a fragmentary, perspective view showing the collector of the ball exchanger; and FIG. 4 is a plane view, on a reduced scale, of the ball exchanger including the collector.

DESCRIPTION OF THE PREFERRED EMBODIMENT

An exemplary ball exchanger embodying many novel features of the present invention is shown in FIGS. 1–4. It includes a ball receiver 1 that is rigidly connected to two frame pieces 2 and 3 to first and second shafts 4 and 5. The shafts 4 and 5 are therefore movable back and forth with the receiver 1. Two parallel bars 6 and 7 each have one end rotatably secured to the first movable shaft 4 and the other end rotatably secured to a first fixed shaft 8.

Both fixed shafts 8 and 9 are attached to a base 11 which may be either heavy or light, but is equipped with means (not shown) to facilitate its attachment to external supports such as tables, walls, or trees. A shock absorber 12 is mounted on the base 11. A cross framework 13 strengthens the parallel bars 6 and 7 (as shown in FIG. 2) and a similar cross framework (not shown) is used between the frames 2 and 3. The movable shafts 4 and 5, the first fixed shaft 8 and a second fixed shaft 9 are parallel to each other and always form the four corners of a parallelogram as the ball receiver 1 recoils, thereby mounting the ball receiver in a fixed vertical orientation.

A bat 10 is pivotably secured to the second fixed shaft 9 and has one end rotatably secured to the second movable shaft 5 nearest the receiver 1 (see FIG. 4). A ball collector 14, having a hole 15 at the bottom, is secured by support 16 to the body 11 and stored ball 17 sits in the hole 15 ready to be struck by the bat 10.

One must consider the inertial forces relative to the second fixed shaft 9 at the instant of collision. The inertia of the parts that are movable with respect to the base 11 may be termed "machine inertia". Whatever point on the ball receiver 1 is struck by an incoming ball or other object, the ball receiver 1 together with the frames 2 and 3 may be considered as centered at the level of the movable shafts 4 and 5 insofar as the inertia is concerned. The incoming ball may, therefore, be considered as if it has hit those shafts. Since inertia is quadratically proportional to the distance of the impact from the fixed shaft 9, the ball receiver 1, together with the frames 2 and 3, contributes the major part of said machine inertia. For the inertia of the incoming ball to be equal to the machine inertia, the total weight of the ball receiver 1 together with frames 2 and 3 is designed to be slightly less than the weight of the incoming ball. The inertia of the stored ball 17 relative to the shaft 9 is easily adjusted by properly locating the hole 15 to give the maximum efficiency.

With no ball stored in the collector 14, the incoming ball hits the ball receiver 1, stops because its inertia is equal to the machine inertia, then drops into the collector 14 toward the hole 15, and finally becomes the stored ball for use later. The ball receiver 1 recoils and causes the parallel bars 6 and 7 as well as the bat 10 to move, but their motion is soon arrested by the shock absorber 12. Since there is no perfect shock absorber, the ball receiver 1 bounces back a little bit, and is then restored to its normal position by gravity or the force of a light spring (not shown).

If a stored ball 17 is sitting in the hole 15 when the incoming ball hits the ball receiver 1, the receiver recoils and causes the bat 10 to move. The bat 10 then hits the stored ball 17 at the designed elevation. Due to proper inertia design as discussed above, tha bat 10, the ball receiver 1, and the incoming ball combined have very little kinetic energy after the collision, and the stored ball 17 alone bounces back with almost all of the kinetic energy. The incoming ball again becomes the stored ball for the next operation of the device.

Since the ball receiver 1 and the bat 10 move very little, frictional losses at the shafts 4, 5, 8 and 9 are negligible. It can be seen from FIG. 1 that the vibration loss is also minimized due to the support of the frame pieces 2 and 3 and the special shape of the bat 10. Furthermore, the bottom ends of the parallel bars 6 and 7, although rotatably secured to the fixed shafts 8, have relatively fixed positions, as does the bat 10, with respect to the shaft 9. Therefore, if the incoming ball hits the left or right side of the ball receiver 1, the torque which tends to rotate the ball receiver 1 is opposed by the parallel relationship between the movable shafts 4 and 5 on the one hand and the fixed shafts 7 and 6 on the other, this relationship being maintained by the bars 6 and 7 and the bat 10. The result is only a slight increase in friction losses when the impact is off-center laterally, and this increase is still negligible as all parts move very little during collision. Therefore, the energy loss is minimized, and, by using balls that bounce well, the stored ball 17 can indeed be sent back a great distance.

The particular design described above is the preferred arrangement to keep the ball receiver 1 in a predetermined orientation as it recoils, so that the inertia of the incoming ball relative to the machine remains the same for different impact points. One may, however, use a bar fixedly attached behind the ball receiver 1 and extending in the direction of movement of the incoming ball. The bar which is used in place of the movable supporting structure described above slides smoothly in a tube-like structure and is supported by small wheel-like bearings to decrease friction. The upper end of the bat 10 is in the recoiling direction of the bar. This modified machine will function much the same as that shown in FIG. 1.

Alternatively, the ball receiver 1 may be fixed directly to the bat 10, without the frames 2 and 3 or parallel bars 6 and 7. But then the area of the ball receiver 1 has to be small for the reasons previously discussed. To shoot accurately, it is then better that the incoming ball be fired from a mechanical ejector rather than thrown with the hands.

The ball receiver 1 and bat 10 can also be built in duplicate, so that each will function in the same manner as the other. Two collectors may then be used. In another variation of the invention, the collector 14 may be fixedly attached to the bat 10, instead of the body 11, but the efficiency is not as high.

While particular forms of the invention have been described, it will be apparent that various modifications can be made without departing from the spirit and scope of the invention.

I claim:

1. A game apparatus comprising:

a base;

receiver means movably supported on said base for presenting a surface arranged to be struck by an incoming object and for producing recoiling movement in response to said incoming object;

collector means for guiding objects which have struck said receiver toward a predetermined location;

bat means for imparting kinetic energy to an object stored at said predetermined location upon actuation thereof; and connecting means for pivotably connecting said bat means to said receiver means to actuate said bat means in response to recoiling movement of said receiver means thereby transferring kinetic energy from said incoming object to said stored object.

2. The game apparatus of claim 1, wherein said collector means is located adjacent said receiver means to catch objects that strike said receiver means.

3. The game apparatus of claim 1, wherein said collector means has a hole therein to position said stored object and to permit said bat means to strike said stored object.

4. The game apparatus of claim 1, wherein the inertia of said receiver means, plus said connecting means, plus said bat means is approximately equal to the inertia of a predetermined incoming object.

5. The game apparatus of claim 1, wherein said connecting means includes at least one member attached to said receiver to maintain said receiver in a fixed orientation, said member being movable with respect to said base.

6. A game apparatus comprising:

a plurality of objects of equal weight to serve as projectiles;

a base;

a movable receiver having a surface arranged to be struck by an incoming one of said objects;

collector means for guiding one of said objects which has struck said receiver toward a predetermined location to become a stored object;

bat means for imparting kinetic energy to said stored object upon actuation thereof; and connecting means for movably connecting said bat means to said receiver to actuate said bat means in response to recoiling movement of said receiver, thereby transferring kinetic energy from said incoming object to said stored object;

the inertia of said receiver, plus said connecting means, plus said bat being approximately equal to the inertia of one of said objects.

7. A game apparatus comprising:

a base;

a movable receiver having a surface arranged to be struck by an incoming object;

collector means for guiding an object which has struck said receiver toward a predetermined location to become a stored object;

bat means for imparting kinetic energy to said stored object upon actuation thereof; and connecting means for movably connecting said bat means to said receiver and to said base to actuate said bat means in response to recoiling movement of said receiver thereby transferring kinetic energy from said incoming object to said stored object, said connecting means retaining said receiver during movement thereof in a predetermined orientation with respect to said base.

8. A game apparatus comprising:

a base;

a receiver having a surface arranged to be struck by an incoming object;

connecting means for movably connecting said receiver to said base to permit recoiling movement of said receiver upon being struck by said incoming object, said connecting means comprising a pair of parallel shafts having fixed locations with respect to said base, a pair of movable shafts parallel to said fixed shafts, and at least one member pivotally interconnecting said fixed and movable shafts;

collector means for holding a stored object; and a means responsive to said recoiling movement of said receiver for transferring kinetic energy from said incoming object to said stored object.

9. The game apparatus of claim 8, wherein said bat is pivotably connected to one of said movable shafts and one of said shafts of fixed location.

10. A game apparatus comprising:

a base;

a receiver having a surface arranged to be struck by an incoming object;

connecting means for movably connecting said receiver to said base to permit recoiling movement of said receiver upon being struck by an incoming object, said connecting means includes a bar and first and second parallel shafts, said bar being pivotably connected to said second shaft, and said receiver being pivotably connected to said bat and said bar;

collector means for holding a stored object; and bat means pivotably connected to said first shaft and responsive to said recoiling movement of said receiver for transferring kinetic energy from said incoming object to said stored object.

11. A game apparatus comprising:

a base;

receiver means movably supported on said base for presenting a surface arranged to be struck by an incoming object and for producing recoiling movement in response to said incoming object;

collector means for guiding objects which have struck said receiver toward a predetermined location;

bat means for imparting kinetic energy to an object stored at said predetermined location upon actuation thereof; and connecting means for movably connecting said bat means to said receiver means to actuate said bat means in response to recoiling movement of said receiver means thereby transferring kinetic energy from said incoming object to said stored object.

* * * * *